United States Patent [19]

Dominguez

[11] 4,114,936

[45] Sep. 19, 1978

[54] IDENTIFICATION OF GEMSTONES BY RELATIVE REFLECTANCE MEASUREMENTS COUPLED WITH A SCALE CALIBRATED IN GEM NAMES

[76] Inventor: Edward Dominguez, 503 Park Ave., San Jose, Calif. 95110

[21] Appl. No.: 794,040

[22] Filed: May 5, 1977

[51] Int. Cl.[2] ..... E05C 19/00

[52] U.S. Cl. ..... 292/342

[58] Field of Search ..... 292/342, 343, 263

[56] References Cited

U.S. PATENT DOCUMENTS

| | | | |
|---|---|---|---|
| 1,042,329 | 10/1912 | Daniels | 292/343 |
| 1,338,205 | 4/1920 | Albright | 292/343 |
| 1,633,202 | 6/1927 | Williams | 292/343 |

*Primary Examiner*—Richard E. Moore

[57] ABSTRACT

A device for limiting the unauthorized opening of a door comprising two elongated channel members that are pivotally attached to each other at one of the ends thereof so that they may be expanded to form a wedge which will limit the opening of the door. The bottom one of the members is attached to the floor, side wall or ceiling adjacent to the door and it is also provided with a prop that is pivotally attached thereto and located thereon so that when the prop is erected it supports one of the members tilted with respect to the other member; that latter member is provided with a screw threaded thereto to engage the top portion of the prop and hold the prop upright whereby the members are retained in the wedge shape until the screw is released.

2 Claims, 8 Drawing Figures

FIG 1
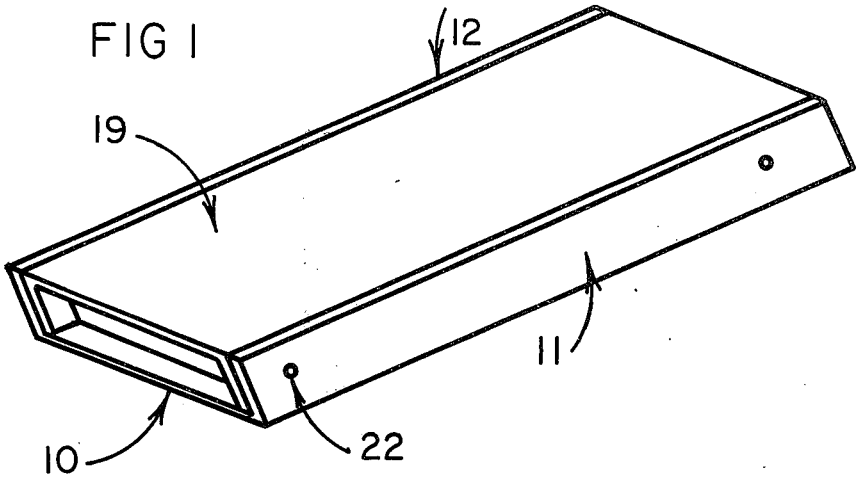
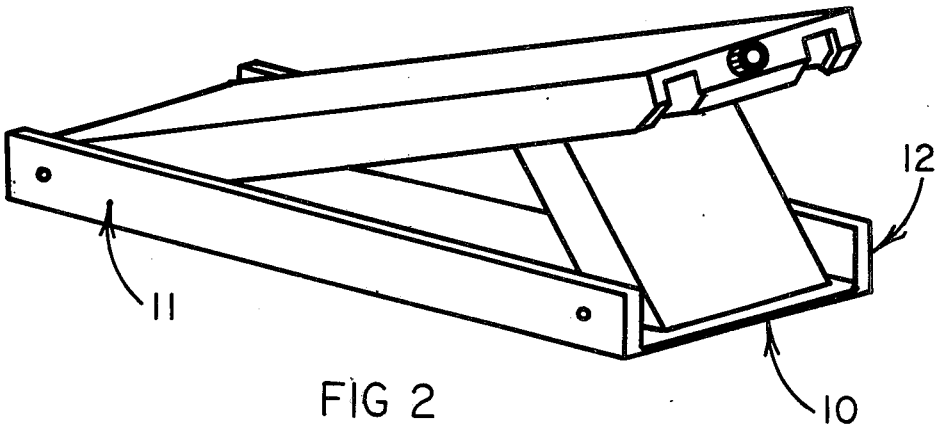
FIG 2
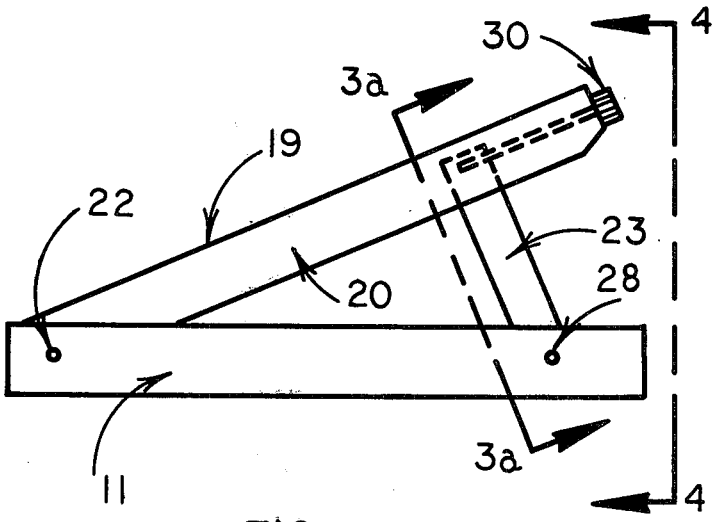
FIG 3

IDENTIFICATION OF GEMSTONES BY RELATIVE REFLECTANCE MEASUREMENTS COUPLED WITH A SCALE CALIBRATED IN GEM NAMES

This invention relates to a device for limiting the unauthorized opening of a door with which the device is associated.

An important object of this invention is to provide a device that is settable to limit the unauthorized opening of a door, said device being constructed so that it is easy to install adjacent to the door to be controlled.

Another object of this invention is to provide a device for limiting the unauthorized opening of a door, said device being provided with a channel member having side walls and a bottom wall that is adapted to be attached to the floor adjacent to the door to be controlled, said side walls being of a height such that the top edges thereof are flush with the top of the carpet or floor covering that has been recessed to provide space for the channel member, said device being provided with another channel member that is pivotally attached to one end thereof to the end of the first channel member closest to the door so that when said other channel member is erected the device forms a wedge that will limit the opening of the door, said device provided with a prop pivotally attached to the first member for holding said other channel member in erect position until released, said prop being positioned between said channel members and being adopted to swing on its pivot to lie between said channel members.

Still another object of this invention is to provide a device for limiting the unauthorized opening of a door, said device being provided with a pair of channel members that are pivotally attached to each other so that they may be erected into a wedge to limit the opening of the door or they may be closed so that one of the channel members rests on and in the other and the top surfaces of the member are flush with the top surface of the carpet or other floor covering.

In accordance with this invention there is provided an improved device that is easy to install and that will limit the unauthorized opening of a door with which it is associated. This device is made using two members of channel iron, aluminum or the like that are pivoted to each other at one end so that they may be collapsed so as to nest against each other. They are expandable into a wedge shape when they are erected adjacent to the door when it is desired that they function to limit the opening of the door. The device is provided with a prop that is pivotally attached to one of the channel members so as to be folded against this member and between both said members when not in use and which is erected to hold said members in said wedge shape when the device is functional. A manually adjustable screw is provided to one of said members for engaging said prop when said prop is erect so that the device is held in said wedge shape until released.

Referring to the drawing briefly:

FIG. 1 is a view of this device showing it in collapsed condition;

FIG. 2 is a view showing this device expanded to wedge shape;

Figure 3A:
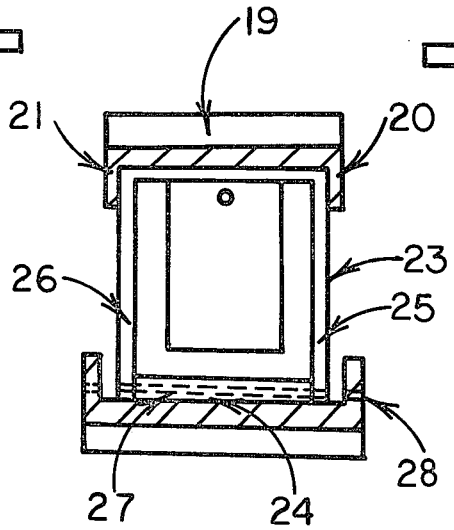
FIG. 3 is a view in side elevation showing this device expanded.

FIG. 3*a* is a sectional view taken along the line 3*a* — 3*a* of FIG. 3.

Figure 4:
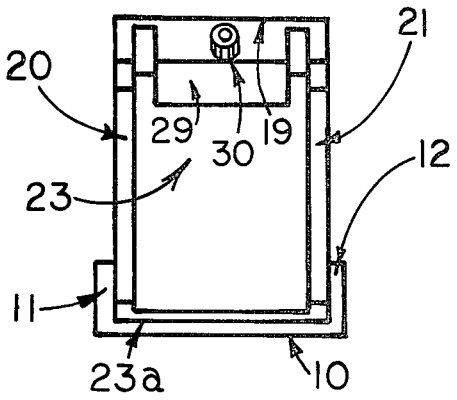
Figure 6:
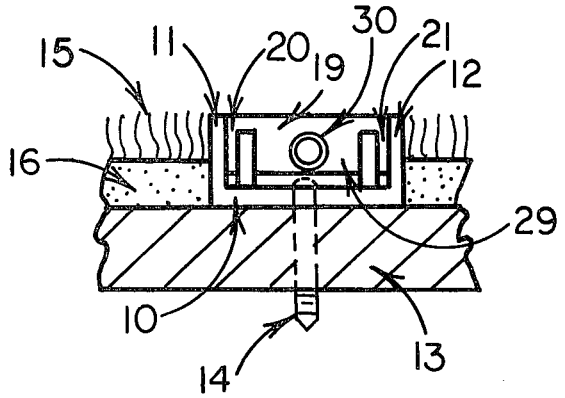
Figure 5:
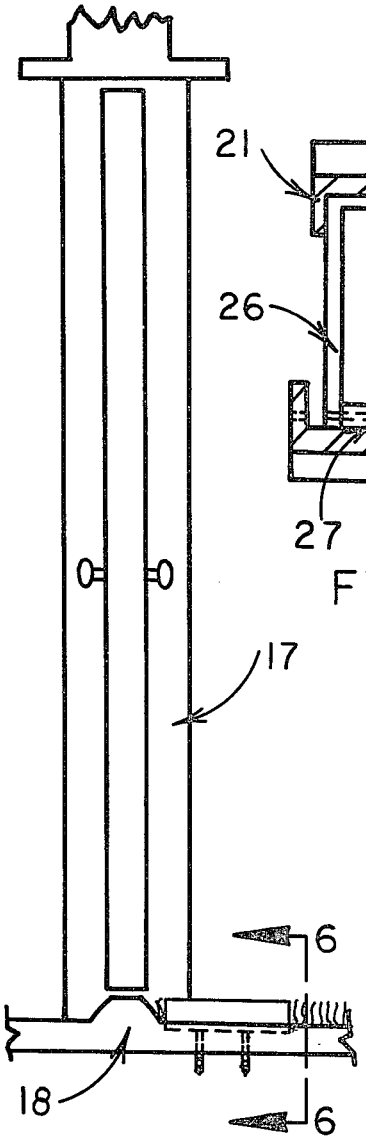
Figure 7:
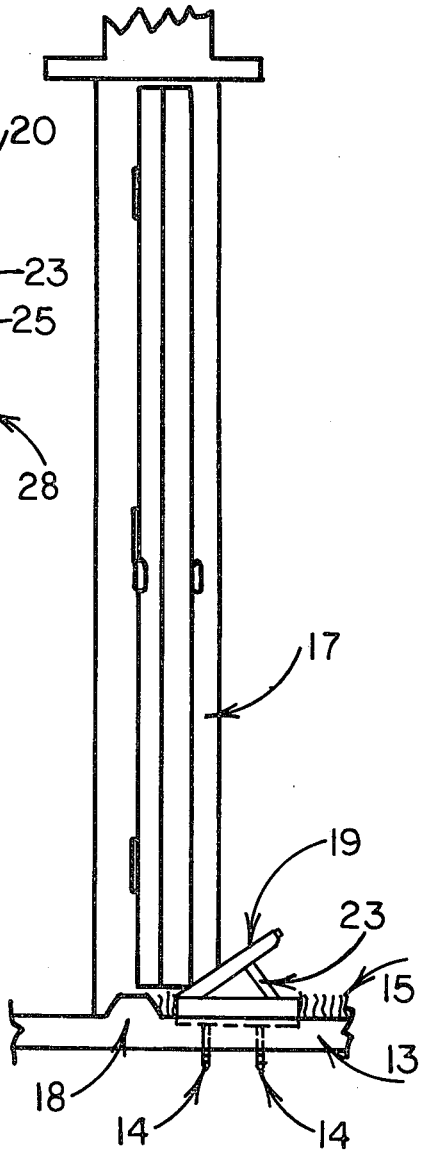

FIG. 4 is a front view of this device taken along the line 4 — 4 of FIG. 3;

FIG. 5 is a view showing this device installed adjacent to a door, said device being shown in collapsed condition to permit opening of the door;

FIG. 6 is an enlarged partial sectional view taken along the line 6 — 6 of FIG. 5; and FIG. 7 is a view similar to FIG. 5 showing the device in expanded condition to limit the opening of the door.

Reference numeral 10 designates the bottom channel member that is provided with side walls 11 and 12. The member 10 is adapted to be attached to the floor 13 by one or more screws 14 after a suitable recess is cut in the carpet 15 and pad 16 adjacent to the door 17.

It will be noted that the side walls 11 and 12 are of a height such that the top surfaces thereof are flush with the top of the carpet 15 so that the device does not protrude above the carpet. Also these top surfaces are even with the top of the member 18 that is located under the closed door as shown in FIG. 5.

This device is provided with another channel member 19 which is provided with side walls 20 and 21 that are pivotally attached to the side walls 11 and 12 respectively of member 10 by the pivot pin 22. The side walls 20 and 21 fit closely against side walls 11 and 12 respectively to prevent dirt and grit from getting into channel member 10 and thereby preventing member 19 from nesting in channel member 10 when it is desired to collapse the device.

Channel member 19 is pivotally attached to channel member 10 by pin 22 as described above so that member 19 may be raised as shown in FIGS. 2 and 7 so that the device forms a wedge adjacent to the door 17 as shown in FIG. 7.

Channel member 19 is held in elevated position shown in FIG. 3 by the prop 23 which is pivotally attached to the projection 24 provided to channel member 10. Prop 23 is provided with side members 25 and 26 that are pivotally attached to projection 24 by the pivot pin 27. Side wall 11 of member 10 is provided with a hole 28 as shown in FIG. 3 so that pin 27 may be inserted into the side members 25 and 26 and projection 24 when these are being assembled.

The forward end of member 19 is provided with a projection 29 on the under side thereof and this projection is provided with a threaded hole for receiving the thumb screw 30. The top of the prop 23 abuts the projection 29 when both member 19 and prop 23 are erected as shown in FIG. 3 and at this time the screw is inserted into a hole provided in the prop 23 to hold the prop in erect position with the upper position of the prop against the inner surface of the projection 29. When the prop 23 is thus erected the bottom edge 23a thereof is positioned against channel member 10. Thus when the door 17 is partially opened as shown in FIG. 7 it cannot be opened further and exerting pressure on the door in an effort to open it further will of course exert pressure on the inclined member 19 and prop 23. Pressure will be transmitted by prop 23 to member 10 since edge 23a of prop 23 rests on member 10.

What I claim is:

1. A device for limiting the unauthorized opening of a door comprising the combination of an elongated channel shape member having a bottom portion and upstanding side walls; means attaching said member adjacent to the door so that said door must swing over said member when said door is opened, and second elongated channel member having a top portion and depending side walls, pivot means pivotally attaching the side walls of said second member to the side walls of said first mentioned members so that said second member is adapted to be tilted with respect to said first mentioned member whereby said members form a wedge adjacent to said door to limit the unauthorized opening of said door, a third member; second pivot means pivotally attaching one end of said third member to said first mentioned member spaced from said first mentioned pivot means so that said third member may be erected with respect to said first mentioned member under said second member to hold said second member in said tilted position; said second member having a threaded hole in one end portion thereof; a screw adjustable in said threaded hole, said screw extending to the upper end portion of said third member when said third member is in erect position, said screw gripping said third member and holding said third member in said erect position until released by withdrawal of said screw.

2. A device for limiting the unauthorized opening of a door as set forth in claim 1 further characterised in that said second channel member has a width less than said first mentioned member and fits into said first mentioned member so that the top surface of said top portion thereof is substantially flush with the tops of said upstanding side walls when said second member is collapsed upon said first mentioned member.

* * * * *

UNITED STATES PATENT OFFICE

CERTIFICATE OF CORRECTION

Patent No. 4,114,936 Dated September 19, 1978

Inventor(s) Edward Dominguez

It is certified that error appears in the above-identified patent and that said Letters Patent are hereby corrected as shown below:

TITLE OF INVENTION SHOULD READ

-- IDENTIFICATION OF WEDGE LOCK BY RELATIVE REFLECTANCE MEASUREMENTS COUPLED WITH A SCALE CALIBRATED IN GEM NAMES --.

Signed and Sealed this

*First* Day of *May 1979*

[SEAL]

*Attest:*

RUTH C. MASON
*Attesting Officer*

DONALD W. BANNER
*Commissioner of Patents and Trademarks*